US007608375B2

(12) United States Patent
Miyakawa

(10) Patent No.: US 7,608,375 B2
(45) **Date of Patent: *Oct. 27, 2009**

(54) LIQUID DEVELOPER AND IMAGE FORMING APPARATUS USING THE SAME

(75) Inventor: Nobuhiro Miyakawa, Shiajiri (JP)

(73) Assignee: Seiko Epson Corporation, Tokyo (JP)

( * ) Notice: Subject to any disclaimer, the term of this patent is extended or adjusted under 35 U.S.C. 154(b) by 425 days.

This patent is subject to a terminal disclaimer.

(21) Appl. No.: 11/565,956

(22) Filed: Dec. 1, 2006

(65) Prior Publication Data

US 2007/0128535 A1 Jun. 7, 2007

(30) Foreign Application Priority Data

Dec. 2, 2005 (JP) ..... 2005-349414
Dec. 9, 2005 (JP) ..... 2005-356295

(51) Int. Cl.
*G03G 9/00* (2006.01)

(52) U.S. Cl. ..... 430/115; 430/116

(58) Field of Classification Search ..... 430/115, 430/116; 399/237

See application file for complete search history.

(56) References Cited

U.S. PATENT DOCUMENTS 5,096,781 A * 3/1992 Vieira et al. ..... 428/32.1
5,622,804 A * 4/1997 Matsuoka et al. ..... 430/115

FOREIGN PATENT DOCUMENTS

JP 2000-019787 1/2000
JP 2003-335998 11/2003

* cited by examiner

*Primary Examiner*—Mark A Chapman
(74) *Attorney, Agent, or Firm*—Hogan & Hartson LLP

(57) ABSTRACT

A liquid developer includes a positively chargeable pigment, a carrier liquid formed of a vegetable oil, and an antioxidant formed of a phosphorous acid ester compound.

10 Claims, 2 Drawing Sheets

LIQUID DEVELOPER AND IMAGE FORMING APPARATUS USING THE SAME

CROSS-REFERENCE TO RELATED APPLICATIONS

This application is based upon and claims the benefit of priority from prior Japanese Patent Application No. 2005-349414, filed Dec. 2, 2005 and No. 2005-356295, filed on Dec. 9, 2005, the entire contents of which are incorporated herein by reference.

BACKGROUND

1. Technical Field

The present invention relates to a liquid developer used in electrophotographic type image forming apparatuses used in photocopiers, printers and the like, and an image forming apparatus using the same.

2. Related Art

Image forming apparatuses using liquid developers are characterized in that, even in the case of using fine particles, high precision images can be formed without having problems caused by scattering of the particles to the outside of the apparatus, and the like. An electrophotographic type image forming apparatus using a liquid developer uses a developer in which colorant particles, or a toner containing colorant and resin as the main components is dispersed in a carrier liquid, and an electrostatic latent image formed on a photoreceptor by exposure is developed using a liquid developer.

After developing, the obtained latent image is transferred onto a recording medium such as paper, and fixed to form an image.

Liquid developers have been generally using petroleum-based volatile hydrocarbon solvents as the carrier liquid. However, although the volatile hydrocarbon solvents are stable materials with low electric conductivities, it is required to volatilize or evaporate the volatile hydrocarbon solvent of the carrier liquid upon fixing the toner transferred or recorded on the recording medium. When evaporated volatile hydrocarbon solvents are discharged, the solvents would cause environmental contamination.

Thus, to give consideration to the environment of use, it is necessary to provide in the vicinity of the fixing apparatus, means for recovering the carrier liquid which has turned into a gas phase. However, an increase of the size is now indispensable for such image forming apparatuses because of the presence of the means for recovering carrier liquid, and thus it is disadvantageous for the image forming apparatuses to be miniaturized.

Furthermore, it has been also proposed to prevent evaporation or volatilization of the carrier liquid by using non-volatile silicone oil or liquid paraffin as the carrier liquid. However, since the chemical properties of these materials as the carrier liquid are stable, the carrier liquid tends to remain on the recording medium even after the fixing process. As a result, there have been problems that the texture of the printing quality is deteriorated, or the presence of the carrier liquid on the paper surface results in deterioration of impressibility, deterioration of the writing characteristics of writing instruments using water-soluble inks, and the like.

Also, during the manufacturing process for the liquid developers according to the related art, while the respective components are used in a state of being dispersed in a non-aqueous, non-polar solvent as the carrier liquid, the properties of the non-polar solvent would cause problems such as large-sized apparatuses, deterioration of the quality of recorded materials, poor storage stability of the liquid developer, and the like.

Meanwhile, it has been repeatedly proposed to use vegetable oils, instead of volatile hydrocarbon organic solvents, as the carrier liquid. For example, JP-A-2000-19787 suggests that by using vegetable oils as the carrier liquid for liquid developers, an odorless carrier liquid with small particle size, having enhanced image density, resolution and fixability, can be obtained.

In the case of preparing a positively charged liquid developer using a vegetable oil as the carrier liquid, it is essential to use a charge controlling agent (CCA) for the process of positive charging. If the amount of the charge controlling agent used is increased, the storability of the dispersion becomes unstable. In particular, when a liquid-state metal soap is used, there is a tendency that the viscosity of the dispersion is increased during long-term storage, and it becomes difficult to expect successful accomplishment of the function from the liquid developer.

On the other hand, when vegetable oils are used as the carrier liquid, there is obtained a feature that oxidative polymerization of the unsaturated bonds present in the vegetable oils brings about rapid and stable image formation of the images transferred onto paper, while there is also a problem that occurrence of the oxidative polymerization at a high rate may lead to a decrease in fluidity during storage, and subsequent deterioration of the carrier liquid.

For example, JP-A-2003-335998 suggests adding an antioxidant to a vegetable oil having an oxo value of 100 to 150, for an emulsion ink useful for stencil printing, which uses a vegetable oil as a dispersion medium, and it is suggested to add bisphenol-based antioxidants, sulfur-based antioxidants, phosphite-based antioxidants and the like as the antioxidant for the purpose.

However, for the use as the carrier liquid of liquid developers, there has been a demand for materials having excellent image forming properties as for the liquid developer, for example, in terms of charging properties, in addition to the problems such as oxidation prevention, polymerization prevention and the like. However, antioxidants have never been examined in relation to the image forming properties and the like.

SUMMARY

An advantage of some aspects of the invention is to provide a liquid developer for positive charging, containing a vegetable oil as the carrier liquid, which liquid developer has stabilized storage properties, and good storability and fixability after transfer to paper or the like, with the property of the colorant, which is dispersed in the vegetable oil, to be charged to a positively charged polarity remaining unimpaired.

According to an aspect of the invention, a positively chargeable liquid developer includes a positively chargeable pigment, a carrier liquid formed of a vegetable oil, and an antioxidant formed of a phosphorous acid ester compound.

The liquid developer according to the aspect of the invention may contain the phosphorous acid ester compound in an amount of 0.2% to 5.0% by weight.

The liquid developer according to the aspect of the invention may contain at least 50% by weight of oleic acid component in the vegetable oil.

The liquid developer according to the aspect of the invention may contain at least one selected from triphenyl phosphite, trioleyl phosphite, diphenyl mono(2-ethylhexyl) phosphite, dilauryl hydrogen phosphite, diphenyl hydrogen phosphite, tetraphenyl tetra(tridecyl)pentaerythritol tetraphosphite, and tetra(C12-C15 alkyl) 4,4'-isopropylidenediphenyl phosphite, as the phosphorous acid ester.

As such, when a positively chargeable liquid developer using a vegetable oil as the carrier liquid, to which developer a phosphorous acid ester is added as an antioxidant, is used, the antioxidant prevents alteration of the vegetable oil during storage, without having adverse effects on the positive charging properties of the liquid developer, and polymerization due to oxidative deterioration, or odor generation can be prevented over a long term. As a result, a liquid developer capable of forming images that are stable for a long time period can be provided.

The liquid developer according to the aspect of the invention may contain a phenolic antioxidant as another antioxidant.

The liquid developer according to the aspect of the invention may contain 0.01% to 5.0% by weight of a phosphorous acid ester compound-based antioxidant, and 0.05 to 0.3% by weight of a phenolic antioxidant. The liquid developer according to the aspect of the invention may contain at least any one of 2,6-di-t-butyl-4-methylphenol and 2,6-di-t-butyl-4-methoxyphenol, as the phenolic antioxidant.

As such, when a phenolic antioxidant is added, the antioxidant prevents alteration of the vegetable oil during storage, without having adverse effects on the positive charging properties of the liquid developer, and polymerization due to oxidative deterioration, or odor generation can be prevented over a long term. As a result, a liquid developer capable of forming images that are stable for a long time period can be provided.

According to another aspect of the invention, an image forming apparatus includes a liquid developer as the developer for developing electrostatic latent images formed on an electrostatic latent image carrier. The liquid developer contains a positively chargeable pigment, and an antioxidant formed of a phosphorous ester compound. In the image forming apparatus according to another aspect of the invention, the liquid developer may further contain a phenolic antioxidant as the antioxidant.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
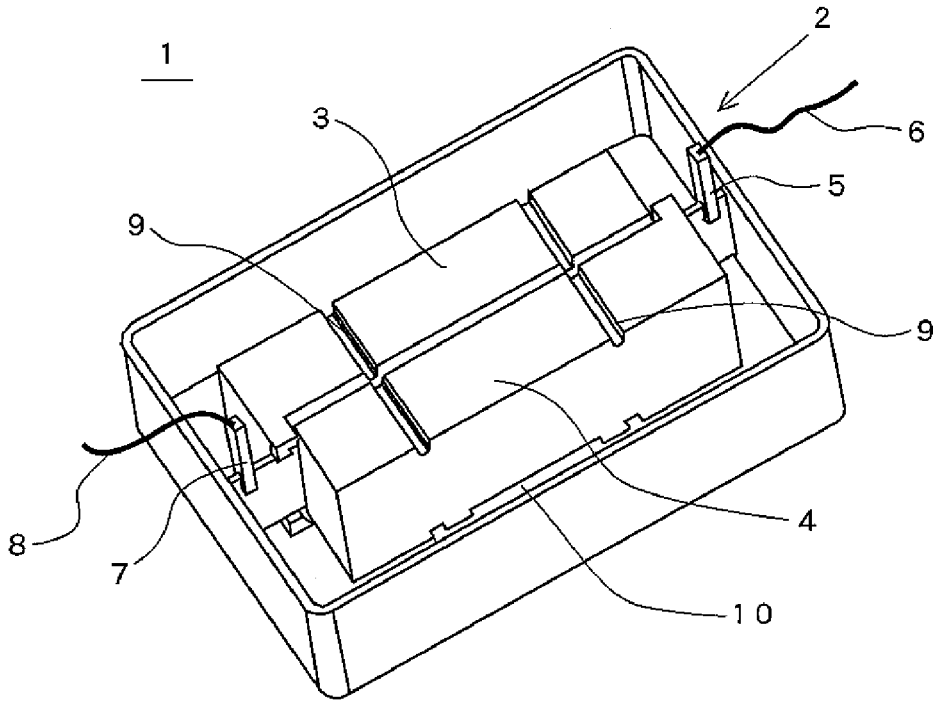
FIGS. 1A and 1B are diagrams illustrating a cell for measuring the charging properties of a pigment dispersed in a vegetable oil according to an embodiment of the invention.

The invention is based on the discovery that when a phosphorous acid ester is added as an antioxidant to a liquid developer for positive charging, which uses a vegetable oil as the carrier liquid, problems such as an increase in the viscosity during storage due to oxidative polymerization and the like can be solved without having adverse effect on the charging properties of the colorant particles, and also that the characteristics of the formed images, such as increased contrast, are improved, as compared with the case of not adding phosphorous acid ester. The invention is also based on the discovery that the fixing properties of the transferred images are not deteriorated by the addition of an antioxidant.

The specific reason why the properties of images are improved upon the addition of phosphorous acid esters is not clear; however, it is conjectured that the addition of a phosphorous acid ester causes the pigment particles in the vegetable oil to attain adequate charging properties, thus enhancing the performance of the liquid developer of positive polarity.

As the vegetable oil that can be used as the carrier liquid of the liquid developer according to an embodiment of the invention, safflower oil, sunflower oil, soybean oil, corn oil, cotton seed oil, rapeseed oil, safflower oil, linseed oil and the like may be mentioned. Fat is an ester composed of one molecule of glycerin and three molecules of fatty acids, that is, a triglyceride, and it is known that when a triglyceride reacts with an alcohol or a fatty acid, transesterified oil can be obtained, with the properties of the raw material fat being modified. The vegetable oil according to the embodiment of the invention also includes transesterified oils prepared by transesterification involving vegetable oils as the raw material. The vegetable oil may be a single species or a mixture of plural species, and may also be a mixture of esters obtained from decomposition of vegetable oils.

In the case of using a mixture of plural species, it is desirable to adjust the kind and mixing amount of the vegetable oils to be mixed, in consideration of the image contrast, fixability and the like.

Examples of the triglyceride composition of the vegetable oils that are used for the liquid developer according to the embodiment of the invention, as expressed in % by weight of the respective constituting fatty acids, such as palmitic acid, stearic acid, oleic acid, linoleic acid and linolenic acid, are as shown in the table below.

In Table 1, MO sunflower oil is midoleic sunflower oil, that is, one having a medium level of oleic acid component in the triglyceride, while the divider oil is a processed oil of rapeseed oil having a high proportion of the oleic acid component. The HOLL canola oil is a product prepared by increasing the content of oleic acid, which is a monovalent unsaturated fatty acid, in the triglyceride and decreasing the content of linolenic acid, which is a trivalent unsaturated fatty acid, in the triglyceride, and is a type of rapeseed oil prepared from rape obtained by breed improvement.

TABLE 1

| Fatty acid | MO sunflower oil | Rapeseed oil | Divider oil | HOLL canola | Safflower oil | Olive oil |
|---|---|---|---|---|---|---|
| Palmitic acid | 3.6% | 4.1% | 4.0% | 4.2% | 4.8% | 10.3% |
| Stearic acid | 3.6% | 1.9% | 2.1% | 2.6% | 1.9% | 2.9% |
| Oleic acid | 60.5% | 62.7% | 72.2% | 73.7% | 76.9% | 78.8% |

TABLE 1-continued

| Fatty acid | MO sunflower oil | Rapeseed oil | Divider oil | HOLL canola | Safflower oil | Olive oil |
|---|---|---|---|---|---|---|
| Linoleic acid | 29.7% | 19.7% | 16.2% | 12.2% | 14.9% | 5.9% |
| Linolenic acid | 0.3% | 8.8% | 4.3% | 3.9% | 0.2% | 0.6% |

Those having high proportions of unsaturated bonds, such as oleic acid, linoleic acid, linolenic acid, undergo oxidative polymerization, and thus, the fixation step may be eliminated or simplified.

Therefore, the vegetable oil of the carrier liquid preferably contains 50% by weight or more of oleic acid as the fatty acid component of triglyceride. Also, for vegetable oils having low proportions of oleic acid component, the content of the oleic acid component in the vegetable oil may be increased by adding oleic acid esters.

The vegetable oil according to the embodiment of the invention is meant to also include those obtained by mixing vegetable oils with linseed fatty acid methyl ester, or by adding oleic acid methyl ester, oleic acid ethyl ester, oleic acid decyl ester and the like, to vegetable oils having low contents of oleic acid component or to transesterified oils having low contents of the oleic acid component, which are obtained from the transesterified oils of vegetable oils. The mixing ratio can be determined by taking the image contrast and fixability into account. It is also desirable to add vegetable oil-derived fatty acids, such as oleic acid, for the adjustment of the properties of the liquid developer, such as viscosity.

According to the embodiment of the invention, the content of the oleic acid component in the vegetable oil means the value determined by a compositional analysis of a fatty acid which is obtained by hydrolysis of a vegetable oil alone, or a mixture of a vegetable oil and other vegetable oil-derived components.

The phosphorous acid ester-based antioxidant that is mixed into the liquid developer according to the embodiment of the invention, is preferably a phosphorous acid ester which is stably present in vegetable oils, preferably being in the liquid state within the operation region for the liquid developer.

Specifically, triphenyl phosphite, trioleyl phosphite, diphenyl mono(2-ethylhexyl) phosphite, dilauryl hydrogen phosphite, diphenyl hydrogen phosphite, tetraphenyl tetra(tridecyl)pentaerythritol tetraphosphite, and tetra(C12-C15 alkyl) 4,4'-isopropylidenediphenyl phosphite may be mentioned.

Furthermore, the content of the phosphorous acid ester compound in the liquid developer is preferably 0.2% to 5.0% by weight.

If the content is less than 0.2% by weight, the effects of improving the image contrast are small. If the content is greater than 5.0% by weight, the fixability is deteriorated.

In addition, the content of the phosphorous acid ester compound in the liquid developer is preferably 0.01% to 5.0% by weight.

If the content is less than 0.01% by weight, the effects of improving the image contrast are small. If the content is more than 5.0% by weight, the fixability is deteriorated.

For the liquid developer according to the embodiment of the invention, in addition to the phosphorous acid ester compounds, phenolic antioxidants may also be added as the antioxidant. The phenolic antioxidants are preferably those that are stably present in vegetable oils.

Specifically, 2,6-di-t-butyl-4-methylphenol, 2,6-di-t-butyl-4-methoxyphenol, 2,6-di-t-butylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-t-butyl-5'-methylbenzyl)-4-methylphenol, 3-t-butyl-4-hydroxyanisole, and 2-t-butyl-4-hydroxyanisole may be mentioned.

Furthermore, 3-(4-hydroxy-3,5-di-t-butylphenyl) stearyl propionate, 3-(4-hydroxy-3,5-di-t-butylphenyl) oleyl propionate, 3-(4-hydroxy-3,5-di-t-butylphenyl) dodecyl propionate, 3-(4-hydroxy-3,5-di-t-butylphenyl) decyl propionate, 3-(4-hydroxy-3,5-di-t-butylphenyl) octyl propionate, tetrakis{3-(4-hydroxy-3,5-di-t-butylphenyl) propionyloxymethyl}methane, 3-(4-hydroxy-3,5-di-t -butylphenyl) propionic acid glycerin monoester, ester of 3-(4-hydroxy-3,5-di-t-butylphenyl) propionic acid and glycerin monooleyl ether, 3-(4-hydroxy-3,5-di-t -butylphenyl) propionic acid butylene glycol ester, 3-(4-hydroxy-3,5-di-t-butylphenyl) propionic acid thiodiglycol ester, and the like may be mentioned.

Also, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-4-methylphenol, 2,6-di-t-butyl-4-(N,N'-dimethylaminomethylphenol), bis(3,5-di-t-butyl-4-hydroxybenzyl) sulfide, tris{(3,5-di-t-butyl-4-hydroxyphenyl)propionyloxyethyl}isocyanurate, tris(3,5-di-t-butyl-4-hydroxyphenyl) isocyanurate, 1,3,5-tris(3,5-di-t-butyl-4-hydroxybenzyl) isocyanurate, bis{2-methyl-4-(3-n-alkylthiopropionyloxy)-5-t-butylphenyl}sulfide, 1,3,5-tris(4-t-butyl-3-hydroxy-2,6-dimethylbenzyl) isocyanurate, tetraphthaloyl di(2,6-dimethyl-4-t-butyl-3-hydroxybenzylsulfide), 6-(4-hydroxy-3,5-di-t -butylanilino)-2,4-bis(octylthio)-1,3,5-triazine, 2,2-thio-{diethyl-bis-3-(3,5-di-t-butyl-4-hydroxyphenyl)}propionate, N,N'-hexamethylenebis(3,5-di-t-butyl-4-hydroxyhydrocinnamide), 3,5-di-t-butyl-4-hydroxy-benzylphosphoric acid diester, bis(3-methyl-4-hydroxy-5-t-butylbenzyl) sulfide, 3,9-bis[1,1-dimethyl-2-{β-(3-t-butyl-4-hydroxy-5-methylphenyl)propionyloxy}ethyl]-2,4,8,10-tetraoxapyro[5,5]undecane, 1,1,3-tris(2-methyl-4-hydroxy-5-t-butylphenyl)butane, 1,3,5-trimethyl-2,4,6-tris(3,5-di-t-butyl-4-hydroxybenzyl)benzene, bis{3,3'-bis-(4'-hydroxy-3'-t-butylphenyl)butyric acid}glycol ester, and the like may be mentioned.

Among these, 2,6-di-t-butyl-4-methylphenol (BHT), and 2,6-di-t-butyl-4-methoxyphenol (BHA) are preferred.

In the case of using the phosphorous acid ester compounds and phenolic antioxidants in combination as the antioxidant, the content of the phosphorous acid ester compound in the liquid developer is preferably 0.01% to 5.0% by weight. If the content is less than 0.01% by weight, the effects of improving the image contrast are small. If the content is more than 5.0% by weight, the fixability is deteriorated. If the content of the phenolic antioxidant is less than 0.05% by weight, the effects of adding the phenolic antioxidant are small. If the content of the phenolic antioxidant is more than 0.3% by weight, the image contrast is deteriorated.

For the liquid developer according to the embodiment of the invention, a charge controlling agent, a resin and the like may be added, in addition to the pigment and the antioxidant of phosphorous acid ester. Specifically, as the charge controlling agent, tetraethyl titanate, tetraisopropyl titanate, tetra-n-propyl titanate, tetra-n-butyl titanate, tetra-tert-butyl titanate, tetra-2-ethylhexyl titanate, tetraethyl titanate, tetramethoxytitanium and the like, or titanium chelates such as titanyl acetyl acetate and the like may be mentioned. Moreover, other examples thereof include titanate coupling agents, for example, isopropyl triisostearoyl titanate, isopropyl tridecylbenzenesulfonyl titanate, isopropyl tris(dioctylpyrophosphate) titanate, tetraisopropyl bis(dioctylphosphite) titanate, tetraoctyl bis(ditridecylphosphite) titanate, tetra(2,2-diallyloxidylmethyl-1-butyl) bis(ditridecyl), bis(dioctylpyrophosphate) ethylene titanate, isopropyl trioctanoyl titanate, isopropyl dimethacryl isostearoyl titanate, isopropyl isostearoyl diacryl titanate, isopropyl tri(dioctylphosphate) titanate, isopropyl tricumylphenyl titanate, and isopropyl tri(N-aminoethyl-aminoethyl) titanate.

In addition, in the case of using a resin, one or two or more resins selected from ethylene/vinyl acetate copolymers, polyester resins, styrene/acrylic resins, rosin-modified resins, polyethylene, ethylene/acrylic acid copolymers, ethylene/maleic anhydride copolymers, polyvinylpyridine, polyvinylpyrrolidone, ethylene/methacrylic acid copolymers, and ethylene/acrylic acid ester copolymers, can be used.

It is preferable for the liquid developer according to the embodiment of the invention that the primary particle size of colored microparticles is set to a particle size of 1 μm or less as the number average particle size, by mixing the vegetable oil, pigment and the like, and dispersing the mixture using an attriter, a sand mill, a ball mill, a vibration mill or the like.

Hereinafter, the method for measuring the charging properties of a pigment according to an embodiment of the invention will be described.

Figure 1B:
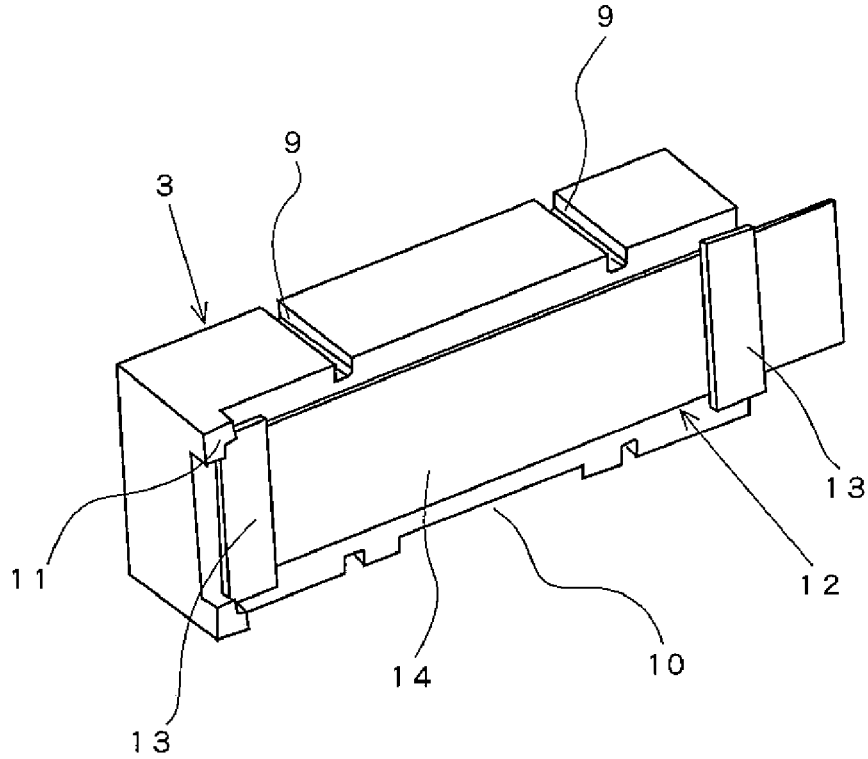

FIGS. 1A and 1B are diagrams illustrating a cell for measuring the charging properties of a pigment dispersed in a vegetable oil according to the embodiment of the invention, and FIG. 1A is a perspective view showing the measuring cell, while FIG. 1B is a perspective view showing the electrode unit.

The measuring cell 1 has an anode electrode unit 3 and a cathode electrode unit 4 installed in a container 2 which is formed from an electrically insulating member such as glass or synthetic resin.

An anode terminal 5 provided in the anode electrode unit 3 is connected to an anode lead wire 6 for power feeding, which is bound to a current supply apparatus (not shown in the figure), while a cathode terminal 7 provided in the cathode electrode unit 4 is connected to a cathode lead wire 8 which is bound to a current supply apparatus (not shown in the figure).

The anode electrode unit 3 and the cathode electrode unit 4 are provided on the top with retention member mounting grooves 9 for the purpose of spacing the two electrode units at a predetermined interval, so that the two electrode units are spaced apart at a predetermined interval during the measurement by mounting retention members.

Furthermore, the anode electrode unit 3 and the cathode electrode unit 4 are provided with a channel groove 10 in the lower part, to allow smooth supplying of pigment dispersion.

Although FIG. 1B illustrates the anode electrode unit, the cathode electrode unit is also formed from the same structure and members.

The anode electrode unit 3 uses a molded body produced by providing projections for anode engagement 11 to a resin having high oil resistance and solvent resistance, such as polyacetal resin (POM).

The projections for anode engagement 11 have an anode 12 mounted together with spacers 13 formed from insulating members for the purpose of maintaining the anode apart from the opposite electrode at a constant interval.

The anode 12 is preferably produced by forming on a transparent glass plate, a transparent conductive film 14 of ITO or the like, which, when a current is applied, does not leach due to the applied current. When an anode produced by forming a transparent conductive film on a transparent glass plate is used, it becomes possible to perform with ease the optical observation and measurement of the pigment deposited on the anode, which is removed from the anode electrode unit, after an electrophoresis performed by passing a current for a predetermined time.

Furthermore, after transferring the pigment by pressing the anode removed from the anode electrode unit onto a transfer member such as paper or synthetic resin film, the pigment concentration may be measured using a reflective concentration meter or the like.

As a comparison is made for the pigment deposited on the anode and the cathode respectively, or for the images transferred therefrom, it can be determined whether the pigment has properties of being positively charged or negatively charged.

Hereinafter, the invention will be described with reference to Examples of the invention.

EXAMPLE 1-1

Preparation of Liquid Developer

In a stainless steel container having a capacity of 500 mL, 320 g of zirconium oxide balls with a diameter of 5 mm, 100 g of MO sunflower oil (Nisshin Oillio Group, Ltd.; 60.5% by weight of the triglyceridic oleic acid component in the vegetable oil), 0.11 g of a dispersant (Ajinomoto Fine-Techno Co., Inc.; Ajisper PA-111), 15 g of Pigment Blue 15:3, a positively chargeable pigment, as a cyan pigment, and 4.17 g of each of the antioxidant indicated in Table 2 were mixed and dispersed using a stirrer (Chuo Rikaki Seisakusho, KK; Tornado SM type propeller stirring blade) at a rotation speed of 504 rpm for 11 hours, to prepare a colorant dispersion.

Diphenyl mono(2-ethylhexyl) phosphite as a phosphite ester was a transparent liquid, 4,4'-thiobis-(2-tert-butyl-5-methylphenol) was a white crystal having a melting point of 124° C., while dibutylhydroxytoluene was a colorless crystal having a melting point of 65° C.

Then, 5 g each of the obtained colorant dispersions was added to 30 g of the MO sunflower oil, and the mixture was sufficiently mixed. Thus, 3 types of liquid developers were obtained. A liquid developer containing no antioxidant was also prepared for a comparative data.

Evaluation of Charging Properties Via Electrophoresis

The charging behavior of the pigment dispersions was investigated using the above-described cell for measuring the charging properties, as shown in FIGS. 1A and 1B. A direct current voltage of 300 V was applied to the cell for measuring the charging properties, at an inter-electrode distance of 2 mm for 10 seconds, to attach colored microparticles to transparent electrodes of ITO via electrophoresis. The transparent electrodes of ITO were removed from the measuring cell, and the colored microparticles attached on the anode and the cathode were transferred by pressing on a transfer paper (Fuji Xerox Office Supply, Inc.; high-quality paper for PPC, J-paper). Thus, the colored microparticles attached on the respective electrodes could be obtained as colored beta images on the transfer paper.

The concentrations of the colored beta images obtained were measured as reflective concentrations using a reflective concentration meter (X-Rite, Inc., Model 520 spectrometric concentration meter), after leaving the images to stand for 1 day. The amount attached on the electrode can be calculated from the reflective concentration value on the transfer paper. That is, if the reflective concentration at the cathode is greater than the reflective concentration at the anode, it can be evaluated that the pigment dispersed microparticles are positively charged, whereas if the reflective concentration at the anode is greater than the reflective concentration at the cathode, the pigment dispersed microparticles are negatively charged. Also, if the reflective concentrations at the anode and the cathode are the same, it can be evaluated that the pigment-dispersed microparticles are neutrally charged.

As discussed above, the reflective concentration values of the beta images transferred onto a transfer paper from the respective electrodes were determined, and the difference was indicated as the image contrast. It can be understood from the magnitude of the difference value as to whether the pigment-dispersed microparticles are sufficiently charged as a positively charged toner. The results of measurement thus determined are presented in Table 2.

TABLE 2

| Type of antioxidant | Image contrast |
|---|---|
| No addition | 0.62 |
| Diphenyl mono(2-ethylhexyl) phosphite | 0.72 |
| 4,4'-thiobis-(2-tert-butyl-5-methylphenyl) | 0.56 |
| Dibutylhydroxytoluene | 0.54 |

According to the results in Table 2, when a phosphorous acid ester was added as an antioxidant, the image contrast was rather of a higher value than that of the case where no antioxidant was added When a phenolic antioxidant was added, the image contrast was of a lower value than that of the case where no antioxidant was added, thus resulting in deterioration of the charging properties for the liquid developer. This is thought to be because, when a phosphorous acid ester is added, the charging property reached a suitable charging region, thus enhancing the image contrast.

EXAMPLE 1-2

Liquid developers were prepared in the same manner as in Example 1-1, except that rapeseed oil (Nisshin Oillio Group, Ltd.; 62.7% by weight of the triglyceridic oleic acid component in the vegetable oil) was used as the vegetable oil, and at the same time, the amount of phosphorous acid ester described in table 3 added to each of the liquid developers was 0.5% by weight. An evaluation of the charging behavior via electrophoresis was performed in the same manner as in Example 1-1, and the results are presented together with the phosphorus content, which represents the content of phosphorus in each of the phosphorous acid esters, expressed in % by weight.

Also, an evaluation of odor was performed via a sensory test according to the evaluation method described below, and the results are also presented in Table 3.

Evaluation Test for Odor Via Sensory Test

A transparent glass container containing a liquid developer was sealed and stored to stand at 40° C. for 6 months. The odor of the stored liquid developer after 6 months was compared with that of a newly prepared liquid developer formed of the same composition. The evaluation of odor was performed as follows by ten evaluators in a sensory test.

Ten evaluators compared the odor of each of the newly prepared liquid developers and the liquid developers after the storage test, and graded the odor in 4 grades with the scores presented below. The weighted averages of the scores from the respective evaluators are presented in Table 3 as the results of the odor test.

0 point: No change at all, 1 point: Slight changes perceived, 2 points: Changes clearly perceived, 3 points: Completely changed, and strong odor perceived.

When the phosphorous acid ester according to the embodiment of the invention was added, the image contrast was of a higher value, as compared with the case of no addition. Also, there was a tendency that a phosphorous acid ester having a higher phosphorus content resulted in a greater image contrast.

The liquid developers having the phosphorous acid esters according to the embodiment of the invention added therein, all yielded weighted averages of 0.1 or 0.2, and can be said to have substantially no change in the odor.

TABLE 3

| Phosphorous acid ester | Phosphorus content (wt %) | Image contrast | Odor test result |
|---|---|---|---|
| No addition | 0 | 0.58 | 1.2 |
| Triphenyl phosphite | 10.0 | 0.81 | 0.2 |
| Trioleyl phosphite | 3.7 | 0.59 | 0.2 |
| Dilauryl hydrogen phosphite | 6.5 | 0.71 | 0.1 |
| Diphenyl hydrogen phosphite | 13.2 | 0.73 | 0.1 |
| Diphenyl mono(2-ethylhexyl) phosphite | 8.6 | 0.86 | 0.2 |
| Tetra(C12-C15 alkyl) 4,4'-isopropylidenediphenyl phosphite | 5.3 | 0.83 | 0.2 |
| Tetraphenyl tetra(tridecyl) pentaerythritol tetraphosphite | 8.7 | 0.81 | 0.2 |

EXAMPLE 1-3

Liquid developers were prepared in the same manner as in Example 1-1, except that rapeseed oil (Nisshin Oillio Group, Ltd.; 79% by weight of the triglyceridic oleic acid component in the vegetable oil, and likewise, 19.7% by weight of linoleic acid component, and 8.8% by weight of linolenic acid) was used as the vegetable oil, and tetra(C12-C15 alkyl) 4,4'-isopropylidenediphenyl diphosphite was used as the phosphorous acid ester, with the amount added being varied from 0.01 to 5.0% by weight.

The charging behavior at room temperature of each of the colorant dispersions was measured at 25° C. in the same manner as in Example 1-1, and the amount of phosphorous acid ester added (% by weight) and the image contrast are presented in Table 4.

Furthermore, an evaluation of the formed images was performed by an image evaluation test described below.

Image Evaluation Test

Figure 2:
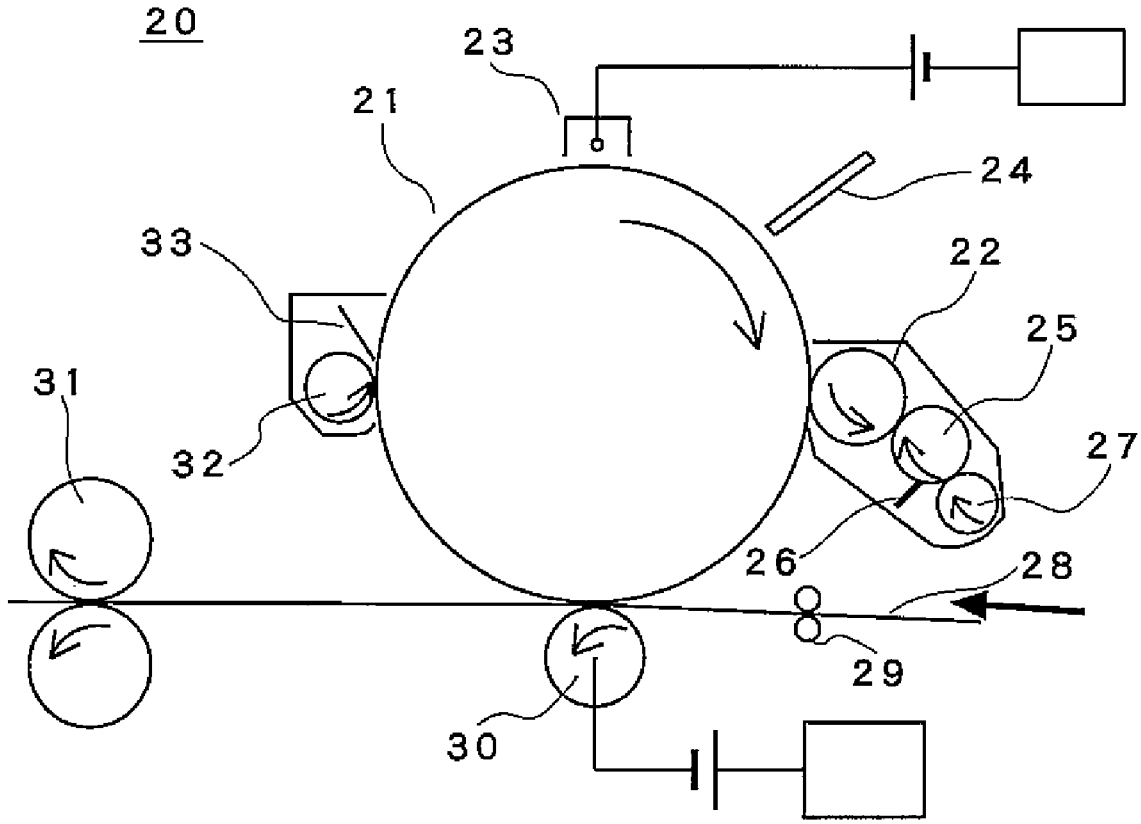
FIG. 2 is a diagram illustrating a liquid developing type image forming apparatus.

The processes of development, transfer, cleaning and fixation were performed using the prepared liquid developers and the liquid developing type image forming apparatus shown in FIG. 2.

In the image forming apparatus 20, a single-layer type, positively charged organic photoreceptor is used as a photoreceptor 21, and a developing roller 22 is formed of an elastic member. First, the surface of the photoreceptor 21 is charged to +650 V using a scorotron 23, and a laser light 24, which is controlled by image signals, is irradiated thereon to form a latent image. Then, a developing bias of +600 V is applied to the developing roller 22 to perform development. The developing roller 22 is supplied with a liquid developer having its layer thickness regulated by a regulating blade 26, and an anilox roller 25 rotates in the same direction with the developing roller 22 while being in contact therewith.

The anilox roller 25 is supplied with the liquid developer from a supply roller 27, which is a sponge-shaped elastic roller. The transfer bias is −950 V, and a transfer paper 28 is supplied as indicated by the arrow, by a pair of supply rollers 29 in synchronization with image transfer at a rate of 200 mm/second.

A transfer roller 30 is an elastic roller, and the transfer bias is applied thereto through a controller. The image transferred onto the transfer paper passes between heat fixing rollers 31, which are formed of an oil-repellant material, and is fixed. The fixing temperature is set to 90° C., and the fixation can be set such that a toner image developed and transferred from the transfer paper does not migrate to another member when the image only contacts it.

In the case where residual toner remains after the transfer, the residual toner is removed by a cleaning blade 33 disposed in the upper part, while a cleaning elastic roller 32 being in contact with the photoreceptor transports the attached liquid developer from the photoreceptor. The cleaned photoreceptor again undergoes the cycle of charging, exposure, development, transfer and cleaning, thus to form a monochromic image.

A 5% coverage document and the beta image were printed out using a liquid developer and the image forming apparatus shown in FIG. 2. The size of the beta image was 20 mm×20 mm. For an evaluation of the fixability, an adhesive tape (Sumitomo 3M, Ltd., mending tape) having a width of 12 mm was adhered on the printout formed on transfer paper (Fuji Xerox Office Supply, Inc.; paper for PPC, J paper), pressed with a roller weighing 500 g in a 10-times shuttling movement, and peeled off. The concentration of the printout remaining on the transfer paper and the concentration before the peel-off were measured using a reflective concentration meter (X-Rite, Inc.), and the ratio of the concentration remaining to the concentration before the peel-off was determined, as expressed in percentage and indicated in Table 4.

TABLE 4

| Amount of phosphorous acid ester added | Image contrast | Fixation ratio |
|---|---|---|
| No addition | 0.58 | 80% |
| 0.01% by weight | 0.51 | 80% |
| 0.1% by weight | 0.51 | 80% |
| 0.2% by weight | 0.60 | 80% |
| 0.3% by weight | 0.63 | 79% |
| 0.5% by weight | 0.86 | 79% |
| 2.0% by weight | 0.77 | 77% |
| 5.0% by weight | 0.69 | 72% |

According to the results obtained above, when the amount of the antioxidant added is more than 0.2% by weight, an increase in the image contrast is observed. If the amount exceeds 5.0% by weight, the fixation ratio is decreased to a larger extent. Therefore, the amount of addition of the antioxidant is preferably set to 0.2% to 5.0% by weight.

EXAMPLE 1-4

In a stainless steel container having a capacity of 500 mL, 320 g of zirconium oxide balls having a diameter of 5 mm, 100 g each of the vegetable oils (all of which, by Nisshin Oillio Group, Inc.), for which the content of fatty acid component in the triglyceride is indicated in Table 5, 15 g of benzimidazolone pigment P.R.185 as a positively chargeable pigment, and 0.23 g of a dispersant (Ajinomoto Fine-Techno Co., Inc.; Ajisper PN-411) were mixed and dispersed using a stirrer (Chuo Rikaki Seisakusho, KK; Tornado SM type propeller stirring blade) at a rotation speed of 504 rpm for 14 hours, to prepare a colorant dispersion.

Then, 5 g of the obtained colorant dispersion was added to 30 g each of the vegetable oils indicated in Table 5, and sufficiently mixed. 0.176 g (corresponding to 0.5% by weight in terms of the amount of addition) of triphenyl phosphite as the antioxidant was added and sufficiently mixed. Thus, 6 kinds of liquid developers were obtained.

Evaluations of the charging behavior, and the fixability by an image evaluation test were performed in the same manner as in Example 1-3, and the results are presented in Table 6 as fixation ratio.

According to the results, it can be seen that a vegetable oil having a high proportion of triglyceridic oleic acid component tends to have a relatively higher image contrast. The fixation ratio was more or less 80% in most of the cases, and large differences were not observed. However, it was observed that a vegetable oil having a high proportion of the oleic acid component tends to have a slightly lower fixation ratio.

TABLE 5

| Fatty acid | MO sunflower oil | Rapeseed oil | Divider oil | HOLL canola | Safflower oil | Olive oil |
|---|---|---|---|---|---|---|
| Palmitic acid | 3.6% | 4.1% | 4.0% | 4.2% | 4.8% | 10.3% |
| Stearic acid | 3.6% | 1.9% | 2.1% | 2.6% | 1.9% | 2.9% |
| Oleic acid | 60.5% | 62.7% | 72.2% | 73.7% | 76.9% | 78.8% |
| Linoleic acid | 29.7% | 19.7% | 16.2% | 12.2% | 14.9% | 5.9% |
| Linolenic acid | 0.3% | 8.8% | 4.3% | 3.9% | 0.2% | 0.6% |

TABLE 6

| Type of vegetable oil | Image contrast | Fixation ratio |
|---|---|---|
| MO sunflower oil | 0.85 | 80% |
| Rapeseed oil | 0.85 | 81% |
| Divider oil | 0.89 | 80% |
| HOLL canola | 0.90 | 80% |
| Safflower oil | 0.90 | 79% |
| Olive oil | 0.91 | 79% |

EXAMPLE 1-5

51 g of an olive oil having triglyceridic fatty acid components in the vegetable oil as follows: 10.3% by weight of palmitic acid, 2.9% by weight of stearic acid, 78.8% by weight of oleic acid, 5.9% by weight of linoleic acid, and 0.6% by weight of linolenic acid; 49 g of linseed fatty acid methyl ester (Nisshin Oillio Group, Inc.), 15 g of benzimidazolone pigment P.R.185, a positively chargeable pigment, and 0.23 g of a dispersant (Ajinomoto Fine-Techno. Co., Inc.; Ajisper PN-411) were used to prepare a colorant dispersion. The proportion of the triglyceridic oleic acid component in the obtained dispersion was 50% by weight.

Subsequently, diphenyl mono(2-ethylhexyl) phosphite was added as the antioxidant to prepare a liquid developer having a content of phosphorous acid ester of 0.5% by weight.

The processes of development, transfer, cleaning and fixation were performed in the same manner as in the method described in Example 1-3, using the obtained liquid developer and the liquid developing type image forming apparatus shown in FIG. 2.

The changes in the image quality and fixability of the obtained printout at 5% coverage over time were evaluated, and the results are presented in Table 7.

For an evaluation of the fixation ratio of the beta portion, the same procedure as the method described in Example 1-3 was performed, and then the initially printed image was stored in an irradiation environment of 730 Lux for 14 hours/day at 25° C. and a relative humidity of 50%, and after 6 months, the fixation ratio of the beta portion was measured again. The liquid developer was also stored for 6 months under the same conditions, while being placed in a beaker without lid.

Also, for a comparison, a liquid developer containing no antioxidant was prepared as a blank.

TABLE 7

| Evaluation | Initial | | After 6 months | |
|---|---|---|---|---|
| results | Blank | Invention | Blank | Invention |
| Dispersibility of liquid developer | Good | Good | Solid-liquid phase separation | Good |
| 4-point font character | Legible | Legible | Hardly legible | Legible |
| Fixability of beta portion | 87% | 87% | 91% | 98% |

As such, the storability of the liquid developer of the invention was good, so that 4-point font characters printed with a liquid developer after storage of 6 months were still legible. However, the liquid developer of the Comparative Example containing no phosphorous acid ester antioxidant underwent solid-liquid phase separation. When this was stirred and introduced into the developing unit of the image forming apparatus, and an image forming test was carried out, precipitation was observed. Further, the printing quality was deteriorated compared to the initial quality, and 4-point font characters were hardly legible. Although the fixability of the printed image was improved, this is thought to be a result of on-going oxidative polymerization of the vegetable oil which serves as the carrier of the developer.

EXAMPLE 2-1

Preparation of Liquid Developer

In a stainless steel container having a capacity of 500 mL, 320 g of zirconium oxide balls with a diameter of 5 mm, 100 g of MO sunflower oil (Nisshin Oillio Group, Ltd.; 60-5% by weight of the triglyceridic oleic acid component in the vegetable oil), 0.11 g of a dispersant (Ajinomoto Fine-Techno Co., Inc.; Ajisper PA-111), and 15 g of Pigment Blue 15:3, a positively chargeable pigment, as a cyan pigment, were mixed and dispersed using a stirrer (Chuo Rikaki Seisakusho, KK; Tornado SM type propeller stirring blade) at a rotation speed of 504 rpm for 11 hours, to prepare a colorant dispersion.

Then, 5 g of the obtained colorant dispersion, and diphenyl mono(2-ethylhexyl) phosphite as a phosphorous acid ester-based antioxidant and 2,6-di-t-butyl-4-methylphenol (BHT) as a phenolic antioxidant, respectively in the amount of mixing indicated in Table 8, were sufficiently mixed and dispersed in 30 g of MO sunflower oil, until the phenolic antioxidant dissolved. A liquid developer containing no antioxidant was also prepared as a blank.

Evaluation of Charging Properties Via Electrophoresis

The cell for measuring charging properties as previously shown in FIGS. 1A and 1B was used to examine the charging behavior of the pigment dispersion. A direct current voltage of 300 V was applied to the cell for measuring charging properties, at an inter-electrode distance of 2 mm for 10 seconds, to attach colored microparticles to transparent electrodes of ITO via electrophoresis. The transparent electrodes of ITO were removed from the measuring cell, and the colored microparticles attached on the anode and the cathode were transferred by pressing on a transfer paper (Fuji Xerox Office Supply, Inc.; high-quality paper for PPC, J-paper). Thus, the colored microparticles attached on the respective electrodes could be obtained as colored beta images on the transfer paper.

The concentrations of the obtained colored beta images were measured, after leaving the images to stand for 1 day, as reflective concentrations using a reflective concentration meter (X-Rite, Inc., Model 520 spectrometric concentration meter) The amount attached on the electrode can be calculated from the reflective concentration value on the transfer paper. That is, it can be determined that if the reflective concentration at the cathode is greater than the reflective concentration at the anode, the pigment-dispersed microparticles are positively charged, whereas if the reflective concentration at the anode is greater than the reflective concentration at the cathode, the pigment-dispersed microparticles are negatively charged. It can also be determined that if the reflective concentrations at the anode and the cathode are the same, the pigment dispersed microparticles are neutrally charged.

As discussed above, the reflective concentration values of the beta images transferred onto transfer paper from the respective electrodes were determined, and the difference was indicated as the image contrast. It can be understood from the magnitude of the difference value as to whether the pigment dispersed microparticles are sufficiently charged as a positively charged toner. The results of measurement thus determined are presented in Table 2.

TABLE 8

| Sample No. | Amount of antioxidant mixed (% by weight) Phosphorous acid ester-based | Phenolic | Image contrast |
|---|---|---|---|
| 1 | No addition | No addition | 0.62 |
| 2 | 0.5 | 0 | 0.72 |
| 3 | 0 | 0.5 | 0.54 |
| 4 | 0 | 0.05 | 0.72 |
| 5 | 0.5 | 0.05 | 0.77 |
| 6 | 0 | 0.1 | 0.80 |
| 7 | 0.5 | 0.1 | 0.82 |
| 8 | 0 | 0.2 | 0.72 |
| 9 | 0.5 | 0.2 | 0.87 |
| 10 | 0 | 0.3 | 0.68 |
| 11 | 0.5 | 0.3 | 0.73 |
| 12 | 0 | 0.4 | 0.61 |
| 13 | 0.5 | 0.4 | 0.64 |
| 14 | 0.5 | 0.5 | 0.45 |

As shown by the results in Table 8, when a phosphorous acid ester-based antioxidant was added, the image contrast was of a higher value than that of the case where no antioxidant was added. On the other hand, when a phenolic antioxidant was added, the image contrast was decreased, compared with the case where no antioxidant was added.

Furthermore, when a phenolic antioxidant was added in addition to a phosphorous acid ester-based antioxidant, the image contrast was further increased, compared with the case of adding the phosphorous acid ester-based antioxidant only.

In addition, when the content of the phenolic antioxidant was greater than 0.4% by weight, the image contrast was decreased.

Diphenyl mono(2-ethylhexyl) phosphite used as the phosphorous acid-based antioxidant is a transparent liquid, while 2,6-di-t-butyl-4-methylphenol (BHT) is a colorless crystal having a melting point of 65° C. However, it is thought that both antioxidants helped in allowing the colorant particles to reach a suitable charging region in the liquid developer, thus enhancing the image contrast.

EXAMPLE 2-2

Liquid developers were prepared in the same manner as in Example 2-1, except that rapeseed oil (Nisshin Oillio Group, Ltd.; 62.7% by weight of the triglyceridic oleic acid component in the vegetable oil) was used as the vegetable oil, and at the same time, the amount of the phosphorous acid ester indicated in Table 9, which was added to each of the liquid developers, was 0.5% by weight, and the amount of 2,6-di-t-butyl-4-methylphenol added as the phenolic antioxidant was 0.2% by weight. An evaluation of the charging behavior via electrophoresis was performed in the same manner as in Example 2-1, and the results are presented together with the phosphorus content, which represents the content of phosphorus in each of the phosphorous acid esters, expressed in % by weight.

Also, an evaluation of odor was performed via a sensory test according to the evaluation method described below, and the results are also presented in Table 9.

Evaluation Test for Odor by Sensory Test

A transparent glass container containing a liquid developer was sealed and stored to stand at 40° C. for 6 months. The odor of the stored liquid developer after 6 months was compared with that of a newly prepared liquid developer formed of the same composition. The evaluation of odor was performed as follows by ten evaluators in a sensory test.

Ten evaluators compared the odor of each of the newly prepared liquid developers and the liquid developers after the storage test, and graded the odor in 4 grades with the scores presented below. The weighted averages of the scores from the respective evaluators are presented in Table 9 as the results of the odor test.

0 point: No change at all, 1 point: Slight changes perceived, 2 points: Changes clearly perceived, 3 points: Completely changed, and strong odor perceived.

When the phosphorous acid ester according to the embodiment of the invention was added, the image contrast was of a higher value, as compared with the case of no addition. Also, there was a tendency that a phosphorous acid ester having a higher phosphorus content resulted in a greater image contrast.

The liquid developers having the phosphorous acid esters according to the embodiment of the invention added therein, all yielded weighted averages of 0.1 or 0.2, and can be said to have substantially no change in the odor.

TABLE 9

| Phosphorous acid ester | Phosphorus content (wt %) | Image contrast | Odor test result |
|---|---|---|---|
| No addition | 0 | 0.58 | 1.2 |
| Triphenyl phosphite | 10.0 | 0.87 | 0.2 |
| Trioleyl phosphite | 3.7 | 0.73 | 0.2 |
| Dilauryl hydrogen phosphite | 6.5 | 0.78 | 0.1 |
| Diphenyl hydrogen phosphite | 13.2 | 0.81 | 0.1 |
| Diphenyl mono(2-ethylhexyl) phosphite | 8.6 | 0.96 | 0.2 |
| Tetra(C12-C15 alkyl) 4,4'-isopropylidenediphenyl phosphite | 5.3 | 0.89 | 0.2 |
| Tetraphenyl tetra(tridecyl) pentaerythritol tetraphosphite | 8.7 | 0.92 | 0.2 |

EXAMPLE 2-3

Liquid developers were prepared in the same manner as in Example 2-1, except that rapeseed oil (Nisshin Oillio Group, Ltd.; 79% by weight of the triglyceridic oleic acid component in the vegetable oil, and likewise, 19.7% by weight of linoleic acid component, and 8.8% by weight of linolenic acid) was used as the vegetable oil, and tetra(C12-C15 alkyl) 4,4'-isopropylidenediphenyl diphosphite was used as the phosphorous acid ester, with the amount added being varied from 0.01 to 5.0% by weight, and also at the same time, the amount of 2,6-di-t-butyl-4-methylphenol added to each of the liquid developers was 0.2% by weight.

The charging behavior at room temperature of each of the colorant dispersions was measured at 25° C. in the same manner as in Example 2-1, and the amount of phosphorous acid ester added (% by weight) and the image contrast are presented in Table 10.

Furthermore, an evaluation of the formed images was performed by the same image evaluation test as the method described in Example 1-3, and the results, expressed in percentage, are presented in Table 10.

TABLE 10

| Amount of phosphorous acid ester added | Image contrast | Fixation ratio |
|---|---|---|
| No addition | 0.66 | 80% |
| 0.01% by weight | 0.69 | 80% |
| 0.1% by weight | 0.73 | 80% |
| 0.3% by weight | 0.88 | 79% |
| 0.5% by weight | 0.92 | 79% |
| 2.0% by weight | 0.90 | 77% |
| 3.0% by weight | 0.83 | 75% |
| 4.0% by weight | 0.71 | 75% |
| 5.0% by weight | 0.59 | 72% |

According to the results obtained above, the image contrast was increased with an increase in the amount of the phosphorous acid ester-based antioxidant added, but was decreased when the amount was 5.0% by weight. Meanwhile, the fixation ratio was gradually decreased with the addition of the antioxidant. The fixation ratio showed substantially no change up to the amount of 0.5% by weight, but after 5% by weight, the fixation ratio was greatly decreased. Therefore, the amount of addition of the antioxidant is preferably set to less than 5% by weight.

EXAMPLE 2-4

In a stainless steel container having a capacity of 500 mL, 320 g of zirconium oxide balls having a diameter of 5 mm, 100 of each of the vegetable oils (all of which, by Nisshin Oillio Group, Inc.), for which the content of fatty acid component in the triglyceride is indicated in Table 11, 15 g of benzimidazolone pigment P.R.185 as a positively chargeable pigment, and 0.23 g of a dispersant (Ajinomoto Fine-Techno Co., Inc.; Ajisper PN-411) were mixed and dispersed using a stirrer (Chuo Rikaki Seisakusho, KK; Tornado SM type propeller stirring blade) at a rotation speed of 504 rpm for 14 hours, to prepare a colorant dispersion.

Then, 5 g of the obtained colorant dispersion was added to 30 g of each of the vegetable oils indicated in Table 11, and sufficiently mixed. 0.176 g (corresponding to 0.5% by weight in terms of the amount of addition) of triphenyl phosphite as a phosphorous acid ester-based antioxidant, and 0.07 g (corresponding to 0.2% by weight in terms of the amount of addition) of 2,6-di-t-butyl-4-methoxyphenol as a phenolic antioxidant were added and sufficiently mixed. Thus, 6 kinds of liquid developers were obtained.

Evaluations of the charging behavior, and the fixability by an image evaluation test were performed in the same manner as in Example 2-3, and the results are presented in Table 12 as fixation ratio.

According to the results, it can be seen that a vegetable oil having a high proportion of triglyceridic oleic acid component tends to have a relatively higher image contrast. The fixation ratio was more or less 80% in most of the cases, and large differences were not observed. However, it was observed that a vegetable oil having a high proportion of the oleic acid component tends to have a slightly lower fixation ratio.

TABLE 11

| Fatty acid | MO sunflower oil | Rapeseed oil | Divider oil | HOLL canola | Safflower oil | Olive oil |
|---|---|---|---|---|---|---|
| Palmitic acid | 3.6% | 4.1% | 4.0% | 4.2% | 4.8% | 10.3% |
| Stearic acid | 3.6% | 1.9% | 2.1% | 2.6% | 1.9% | 2.9% |
| Oleic acid | 60.5% | 62.7% | 72.2% | 73.7% | 76.9% | 78.8% |
| Linoleic acid | 29.7% | 19.7% | 16.2% | 12.2% | 14.9% | 5.9% |
| Linolenic acid | 0.3% | 8.8% | 4.3% | 3.9% | 0.2% | 0.6% |

TABLE 12

| Type of vegetable oil | Image contrast | Fixation ratio |
|---|---|---|
| MO sunflower oil | 0.89 | 80% |
| Rapeseed oil | 0.89 | 81% |
| Divider oil | 0.95 | 80% |
| HOLL canola | 0.94 | 80% |
| Safflower oil | 0.95 | 79% |
| Olive oil | 0.95 | 78% |

EXAMPLE 2-5

51 g of an olive oil having triglyceridic fatty acid components in the vegetable oil as follows: 10.3% by weight of palmitic acid, 2.9% by weight of stearic acid, 78.8% by weight of oleic acid, 5.9% by weight of linoleic acid, and 0.6% by weight of linolenic acid; 49 g of linseed fatty acid methyl ester (Nisshin Oillio Group, Inc.), 15 g of benzimidazolone pigment P.R.185, a positively chargeable pigment, and 0.23 g of a dispersant (Ajinomoto Fine-Techno Co., Inc.; Ajisper PN-411) were used to prepare a colorant dispersion. The proportion of the triglyceridic oleic acid component in the obtained dispersion was 50% by weight.

Subsequently, a liquid developer containing 0.5% by weight of diphenyl mono(2-ethylhexyl) phosphite as a phosphorous acid ester-based antioxidant and 0.2% by weight of 2,6-di-t-butyl-4-methoxyphenol as a phenolic antioxidant was prepared.

The processes of development, transfer, cleaning and fixation were performed in the same manner as in the method described in Example 2-3, using the obtained liquid developer and the liquid developing type image forming apparatus shown in FIG. 2. The changes in the image quality and fixability of the obtained printout at 5% coverage over time were evaluated, and the results are presented in Table 13.

For an evaluation of the fixation ratio of the beta portion, the same procedure as the method described in Example 2-3 was performed, and then the initially printed image was stored in an irradiation environment of 730 Lux for 14 hours/day at 25° C. and a relative humidity of 50%, and after 6 months, the fixation ratio of the beta portion was measured again. The liquid developer was also stored for 6 months under the same conditions, while being placed in a beaker without lid.

Also, for a comparison, a liquid developer containing no antioxidant was prepared as a blank.

TABLE 13

| Evaluation | Initial | | After 6 months | |
|---|---|---|---|---|
| results | Blank | Invention | Blank | Invention |
| Dispersibility of liquid developer | Good | Good | Solid-liquid phase separation | Good |
| 4-point font character | Legible | Legible | Hardly legible | Legible |
| Fixability of beta portion | 87% | 87% | 91% | 98% |

As such, the storability of the liquid developer of the invention was good, so that 4-point font characters printed with a liquid developer after storage of 6 months were still legible. However, the liquid developer of the Comparative Example containing no phosphorous acid ester antioxidant and no phenolic antioxidant underwent solid-liquid phase separation. When this was stirred and introduced into the developing unit of the image forming apparatus, and an image forming test was carried out, precipitation was observed. Further, the printing quality was deteriorated compared to the initial quality, and 4-point font characters were hardly legible. Although the fixability of the printed images was improved, this is thought to be a result of on-going oxidative polymerization of the vegetable oil which serves as the carrier of the developer.

What is claimed is:

1. A liquid developer comprising a positively chargeable pigment, a carrier liquid formed of a vegetable oil, and an antioxidant formed of a phosphorous acid ester compound, wherein the phosphorous acid ester compound is in an amount of 0.2% to 5.0% by weight.

2. The liquid developer according to claim 1, wherein the vegetable oil contains at least 50% by weight of oleic acid component.

3. The liquid developer according to claim 1, wherein the phosphorous acid ester is at least one selected from triphenyl phosphite, trioleyl phosphite, diphenyl mono(2-ethylhexyl) phosphite, dilauryl hydrogen phosphite, diphenyl hydrogen phosphite, tetraphenyl tetra (tridecyl) pentaerythritol tetraphosphite, and tetra(C12-C15 alkyl) 4,4'-isopropylidenediphenyl phosphite.

4. The liquid developer according to claim 1, further comprising a phenolic antioxidant as the antioxidant.

5. The liquid developer according to claim 4, further comprising 0.05% to 0.3% by weight of a phenolic antioxidant.

6. The liquid developer according to claim 5, wherein the phenolic antioxidant is at least one selected from 2,6-di-t-butyl-4-methylphenol and 2,6-di-t-butyl-4-methoxyphenol.

7. The liquid developer according to claim 4, wherein the vegetable oil contains at least 50% by weight of triglyceridic oleic acid component.

8. The liquid developer according to claim 4, wherein the phosphorous acid ester is at least one selected from triphenyl phosphite, trioleyl phosphite, diphenyl mono(2-ethylhexyl) phosphite, dilauryl hydrogen phosphite, diphenyl hydrogen phosphite, tetraphenyl tetra (tridecyl) pentaerythritol tetraphosphite, and tetra(C12-C15 alkyl) 4,4'-isopropylidenediphenyl phosphite.

9. An image forming apparatus comprising a liquid developer as the developer for developing an electrostatic latent image formed on an electrostatic latent image carrier, wherein the liquid developer comprises a positively chargeable pigment, an antioxidant formed of a phosphorous acid ester compound, and a carrier liquid formed of a vegetable oil, wherein the phosphorous acid ester compound is in an amount of 0.2% to 5.0% by weight.

10. The image forming apparatus according to claim 9, further comprising a phenolic antioxidant as the antioxidant.

* * * * *